US012128282B2

(12) United States Patent
Matthes

(10) Patent No.: US 12,128,282 B2
(45) Date of Patent: Oct. 29, 2024

(54) SPORT EQUIPMENT BALANCE ACCESSORY

(71) Applicant: Kent Matthes, Orlando, FL (US)

(72) Inventor: Kent Matthes, Orlando, FL (US)

(73) Assignee: Velo Sports LLC, Tulsa, OK (US)

( * ) Notice: Subject to any disclaimer, the term of this patent is extended or adjusted under 35 U.S.C. 154(b) by 0 days.

(21) Appl. No.: 18/399,900

(22) Filed: Dec. 29, 2023

(65) Prior Publication Data

US 2024/0226680 A1 Jul. 11, 2024

Related U.S. Application Data

(60) Provisional application No. 63/437,522, filed on Jan. 6, 2023.

(51) Int. Cl.
*A63B 60/24* (2015.01)
*A63B 60/16* (2015.01)
*A63B 60/02* (2015.01)

(52) U.S. Cl.
CPC ..... *A63B 60/24* (2015.10); *A63B 60/16* (2015.10); *A63B 60/02* (2015.10)

(58) Field of Classification Search
CPC ..... A63B 60/02; A63B 60/24; A63B 60/16; A63B 69/0002; A63B 2069/0008
USPC ..... 473/256
See application file for complete search history.

(56) References Cited

U.S. PATENT DOCUMENTS

| | | | | |
|---|---|---|---|---|
| 4,936,586 | A * | 6/1990 | Van Raemdonck | A63B 49/08 473/297 |
| 5,741,193 | A * | 4/1998 | Nolan | A63B 60/16 473/519 |
| 10,751,593 | B2 * | 8/2020 | Brown | A63B 21/0004 |
| 2014/0342854 | A1 * | 11/2014 | Thurman | A63B 59/58 473/519 |
| 2016/0089586 | A1 * | 3/2016 | Sawyer | A63B 60/02 473/564 |
| 2016/0263453 | A1 * | 9/2016 | Gormley | A63B 53/14 |
| 2017/0100650 | A1 * | 4/2017 | Anderle | A63B 69/0002 |
| 2019/0091536 | A1 * | 3/2019 | Brown | A63B 21/0604 |
| 2019/0366173 | A1 * | 12/2019 | Lindemann, II | A63B 59/50 |
| 2019/0388749 | A1 * | 12/2019 | Codd | A63B 69/0002 |
| 2021/0121754 | A1 * | 4/2021 | Chauvin | A63B 59/56 |

FOREIGN PATENT DOCUMENTS

| | | | | |
|---|---|---|---|---|
| WO | WO2007124956 | * 11/2007 | | A63B 60/02 |

* cited by examiner

*Primary Examiner* — John E Simms, Jr.
(74) *Attorney, Agent, or Firm* — Losey PLLC; Ian Johnson

(57) ABSTRACT

The present application discloses an accessory for items of sporting equipment. Implementations may provide an accessory comprising a structure configured to be affixed to a first end of an item of sporting equipment meant to be swung or rotated, such as a baseball bat, lacrosse stick, or tennis racquet. The addition of the accessory results in movement of the center of mass of the sporting item. Implementations may be varied in weight and dimension such that the center of mass of the sporting item is moved to a location optimal for the demands of the sport and individual athletes' needs. Implementations may also provide for modifiable weight or dimension of the accessory.

4 Claims, 15 Drawing Sheets

SPORT EQUIPMENT BALANCE ACCESSORY

FIELD OF THE DISCLOSURE

The present disclosure is directed to equipment for sports. In particular, the present disclosure is directed to accessories for baseball, softball, other bat sports, and other sports involving swinging or similarly moving a piece of equipment.

BACKGROUND OF THE DISCLOSURE

A baseball bat is one of the primary pieces of equipment in the game of baseball. Baseball bats are smooth, cylindrical clubs typically made of wood or metal. A player holds the bat at one end and swings it at the ball when pitched, with the goal of hitting the ball into the field of play. The diameter of the bat may vary along its length, and the length, size, and weight may be limited by rules imposed by the relevant baseball league. Softball bats are similar pieces of equipment with similar roles in the game of softball. Additionally, many other sports utilize bats or similar equipment intended for swinging as part of play, such as cricket, tennis, hockey, lacrosse, and golf.

BRIEF DESCRIPTION OF THE DRAWINGS

Various objects, aspects, features, and advantages of the disclosure will become more apparent and better understood by referring to the detailed description taken in conjunction with the accompanying drawings, in which like reference characters identify corresponding elements throughout. In the drawings, like reference numbers generally indicate identical, functionally similar, or structurally similar elements.

DETAILED DESCRIPTION

This application claims the benefit of and priority to provisional application U.S. 63/437,522, filed Jan. 6, 2023, the entirety of which is incorporated herein by reference.

Figure 1:
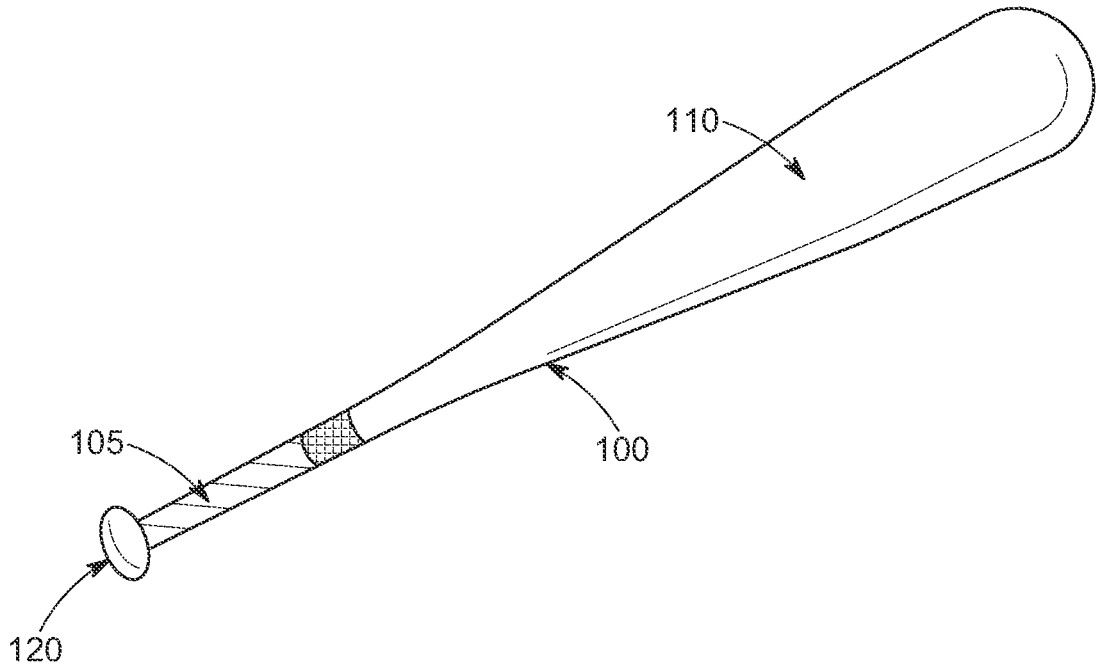
FIG. 1 is a perspective view of an implementation of a baseball bat.

FIG. 1 is a perspective view of an implementation of a baseball bat.

Baseball bat 100 is one of the primary pieces of equipment in the game of baseball. Bat 100 comprises a cylindrical structure with a first distal end and a second distal end, where the first and second distal ends are opposite each other along the length of bat 100. The first distal end comprises a first diameter, and the second distal end comprises a second diameter, where the second diameter is larger than the first. In some implementations, the diameter of bat 100 tapers from the first distal end to the second distal end.

In some implementations, bat 100 comprises a handle 105. Handle 105 comprises the area adjacent to the first distal end comprising a first diameter. In some implementations, bat 100 comprises a barrel 110. Barrel 110 comprises the area adjacent to the second distal end comprising a second diameter.

In some implementations, bat 100 comprises a knob 120. Knob 120 may comprise a structure located at the first distal end of bat 100 (i.e., adjacent to handle 105) with a greater diameter than handle 105. In some implementations, knob 120 comprises a diameter equal to or greater than its length.

During the play of the game, a player batting will hold bat 100 by wrapping his or her hands around the handle 105. The goal of the player at bat is to swing bat 100 at a ball thrown by the pitcher and make contact with the ball, thereby putting the ball into the field of play. In most situations, the goal is to make contact with the ball with the barrel 110 of bat 100. In practice, the greater diameter of knob 120 may prevent bat 100 from leaving the player's hand s during a swing.

In some implementations, bat 100 is manufactured of a single material. In some implementations, bat 100 comprises wood, such as maple, hickory, oak, ash, bamboo, or the like. In some implementations, bat 100 comprises a metal or metal alloy, such as aluminum. In some implementations, bat 100 comprises a composite material. In some implementations, bat 100 comprises a solid structure. In other implementations, bat 100 comprises a hollow structure.

In the game of baseball, players want to maximize the energy transferred from the bat to the ball when making contact with a pitch, which results in a greater velocity of the ball leaving contact with the bat, translating to further travel distance and time for the ball and increased opportunities for the batter to reach base or achieve a home run. Maximizing this energy transfer requires balancing multiple factors—the player's swing speed, the player's ability to control the area of the impact of the bat and ball, and the bat's characteristics itself.

The dimensions of bat 100 can greatly affect its performance. For example, the relationship between the weight and length of bat 100 is known as "bat drop." Bats with larger "bat drop," i.e., bats which are lighter and longer, often enable greater swing speed, while bats with smaller "bat drop," i.e., bats which are shorter and heavier, increase the ability to transfer more energy to the ball upon contact, colloquially known as increased hitting power.

Beyond the weight of a bat affecting its performance, the distribution of this weight is also consequential. Because barrel 110 is generally of greater diameter than handle 105, a bat 100 comprising a single solid structure will have a center of mass located closer to the barrel 110. Similar, distributions of mass in hollow or multi-material bats also generally result in a center of mass located closer to barrel 110. This distribution of mass results in the bat having a balance point further away from the player's grip on handle 105. As the distance of the center of mass of bat 100 moves further away from the player's grip on handle 105, the player must exert greater force to achieve the same swing speed and bat momentum. This may frustrate younger or weaker players who have not developed the capability to swing bats with centers of mass further from the handle 105.

This phenomenon has also been utilized in attempts to improve player performance. For example, U.S. Pat. No. 7,128,667 issued to Nolan ("Nolan") teaches a training weight belt configured for placement around barrel 110 of bat 100. By adding additional weight away from the player's grip on handle 105, the player must increase the force applied to swing the bat. Repeating this process over time theoretically leads to increased player strength, which translates into greater swing speed and bat momentum when the training weight device is removed. While this training method may have benefits, it carries several drawbacks. As Nolan recognizes, weight placed along the barrel 110 can impede proper swing mechanics and produce counterproductive results. Further, the use of this type of training device places excess stress on the joints, muscles, tendons, and other tissues of the player during training, resulting in increased risk of fatigue and injury. Finally, these devices are for training purposes only. They cannot be used during live play due to practical concerns as well as league regulations. In addition to removing any benefit of use during gameplay, the change in bat balance between training and game situations may negatively impact the player's performance.

It may be desirable to move the center of mass closer to handle 105 of bat 100 by increasing the weight at the first distal end of bat 100 adjacent to handle 105. Adjusting the center of mass of the bat in this manner may improve the overall balance of the bat, improve a player's control of his or her swing, and allow for equal or improved swing speed compared to a traditional bat while simultaneously increasing the mass of the bat. This increased mass combined with equal or improved swing speed results in greater swing momentum and therefore greater transfer of energy to the ball upon contact. The movement of the center of mass may also reduce the force needed to achieve similar or superior swing momentum when compared to traditional bats, thereby reducing the risk of player injuries during practice and games.

Certain players in Major League Baseball have found that by increasing the weight towards the handle 105 of bat 100 has improved various aspects of bat performance, with corresponding improvements in their hitting capabilities when using these bats. However, this has only been achieved by fabrication of custom wood bats for each player following exhaustive analysis of the individual player's swing motion and other data. This renders existing solutions inadequate for the vast majority of baseball and softball players, who lack the time, money, resources, and access to obtain customized equipment. Further, because each of these bats is custom made, the weight distribution is fixed and cannot be changed during training or games in response to various situations or to permit the adjustment of a bat for use by multiple players with different balance needs. Existing training devices utilizing this phenomenon are drawn to altering a player's swing mechanics or improving a player's physical strength, rather than optimizing bat characteristics and/or performance. These devices are also limited to training rather than in-game use.

The present invention aims to remedy these shortcomings by providing a device capable of moving the center of mass of a bat 100 closer to the handle 105 which is adjustable, removable, and capable of use on a variety of bats as well as on other items of sporting equipment that are swung or rotated during use.

Figure 2A:
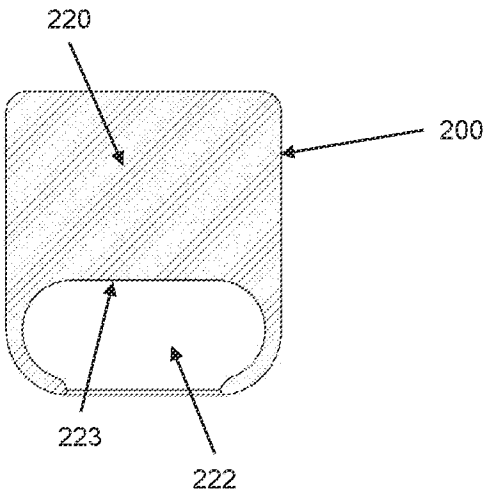
FIG. 2A is a side view of an implementation of a balance accessory.

FIG. 2A is a side view of an implementation of a balance accessory.

In some implementations, a balance accessory 200 comprises an enclosure 220. Enclosure 220 may comprise a structure configured to attach or affix to the knob 120 (not shown) of a bat. Enclosure 220 may comprise one or more structures comprising one or more materials according to different implementations. In some implementations, enclosure 220 comprises material(s) and dimensions such that enclosure 220 is of a desirable weight. For example, in some implementations, enclosure 220 may comprise dimensions and material(s) such that enclosure 220 has a weight of one half ounce, one ounce, one and one half ounces, two ounces, two and one half ounces, three ounces, or the like.

The desirability of the weight of enclosure 220 may vary depending on the player and bat or equipment on which the balance accessory is used, as well as the needs of the game and rules thereof. Specifically, the desirability of the weight will be such that when enclosure 220 is affixed to an end of a piece of sporting equipment, the center of mass of the sporting equipment is moved closer to the end to which the accessory is affixed. In some implementations, the weight of enclosure 220 and/or the accessory may be between 0.05% and 50% of the weight of the sporting equipment. In some implementations, the weight of enclosure 220 and/or the accessory may be between 0.25% and 25% of the weight of the sporting equipment. In some implementations, the weight of enclosure 220 and/or the accessory may be between 0.25% and 15% of the weight of the sporting equipment. In some implementations, the weight of enclosure 220 and/or the accessory may be between 0.25% and 10% of the weight of the sporting equipment. In some implementations, the weight of enclosure 220 and/or the accessory may be between 0.25% and 5% of the weight of the sporting equipment.

Enclosure 220 may be comprised of such material(s) and dimensions to achieve any weight value which may be desirable for an individual use case.

In some implementations, enclosure 220 may comprise a knob cavity 222. Knob cavity 222 may comprise an opening in the structure of enclosure 220 configured to receive a knob of a bat. The dimensions of knob cavity 222 may be configured to the particular bat knob dimensions to accommodate different sized and shaped equipment. In some implementations, the dimensions of knob cavity 222 may be configured to the size and shape of the end of the item of sporting equipment the accessory is intended to be affixed to.

In some implementations, knob cavity 222 may comprise an inner surface 223 configured to engage with the surface of a knob of a bat. In some implementations, inner surface 223 may comprise a different material than the remainder of enclosure 220. In some implementations, inner surface 223 may comprise a surface with a high coefficient of friction, i.e. a material with low ability to slip with respect to the knob when the inner surface is engaged with the knob. In some implementations, inner surface 223 may comprise a material with adhesive properties. In some implementations, inner surface 223 may comprise a different material than the other portions of the balance accessory 200.

Figure 2B:
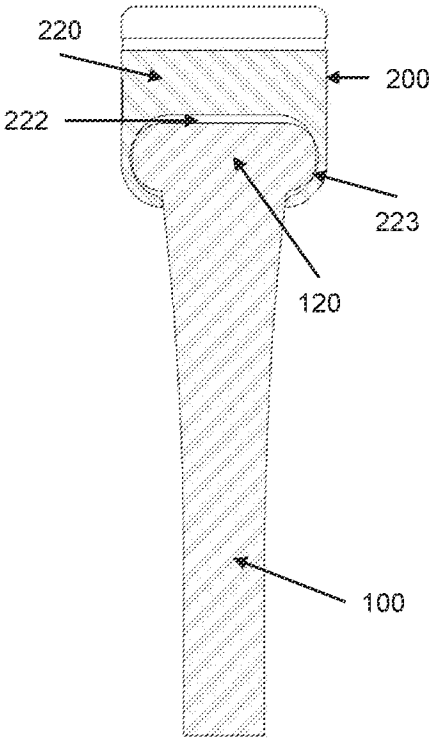
FIG. 2B is a side view of an implementation of a balance accessory affixed to a bat.

FIG. 2B is a side view of an implementation of a balance accessory affixed to a bat.

In some implementations knob cavity 222 comprises a continuous structure, i.e., it encloses the knob in a 360-degree manner with respect to the knob's circumference. In some implementations, knob cavity 222 acts as a sleeve and fits over the knob of a bat. In some implementations, knob cavity 222 comprises a flexible material that is capable of expanding to receive the knob of a bat and then contracting to fit against the knob of the bat, thus securing the balance accessory to the knob. In some implementations, knob cavity 222 comprises a non-continuous structure, i.e. it does not fully enclose the knob on all sides.

In the implementation shown in FIG. 2B, knob 120 has been inserted into knob cavity 222. In the implementation shown, inner surface 223 is in contact with knob 120 on two sides of knob 120. In other implementations, inner surface 223 may be in contact with knob 120 on other faces of knob 120. In some implementations, the entirety of inner surface 223 may be in contact with knob 120.

Figure 2C:
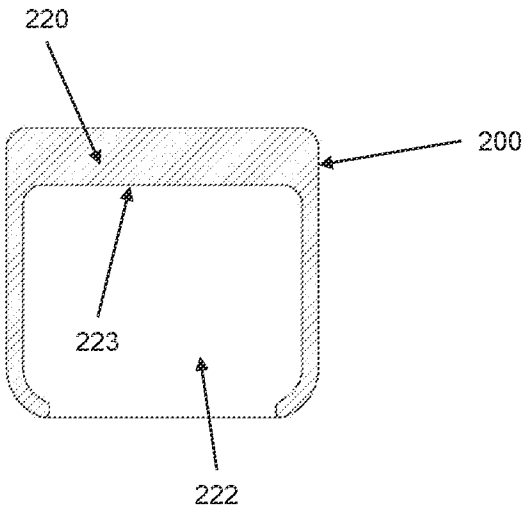
FIG. 2C is a side view of an implementation of a balance accessory.

FIG. 2C is a side view of an implementation of a balance accessory.

In the implementation shown in FIG. 2C, knob cavity 222 is configured to fit a knob (not shown) with larger dimensions than the implementation shown in FIGS. 2A and 2B. Knob cavity 222 may be configured to fit different sizes of knobs, and for different sizes, shapes, and dimensions of other sporting equipment.

Figure 3A:
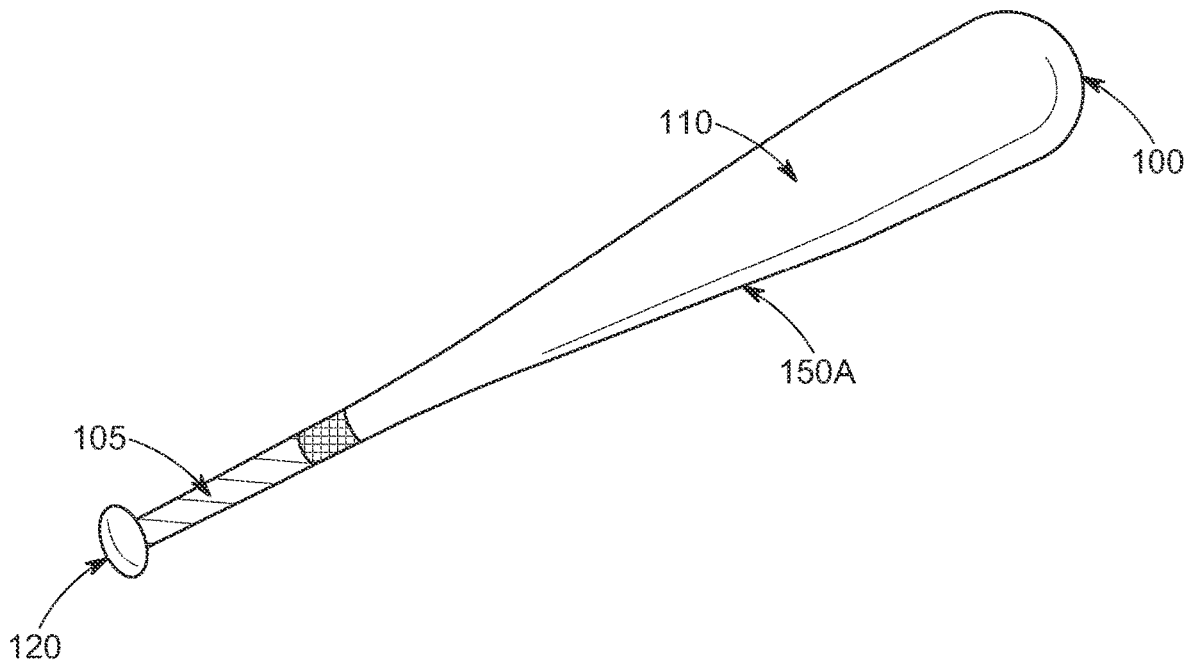
FIG. 3A is a perspective view of a bat.

FIG. 3A is a perspective view of a bat.

As discussed previously, the dimensions of bat 100 result in bat 100 having a center of mass 150A further away from the knob 120 and handle 105 and closer to barrel 110.

Figure 3B:
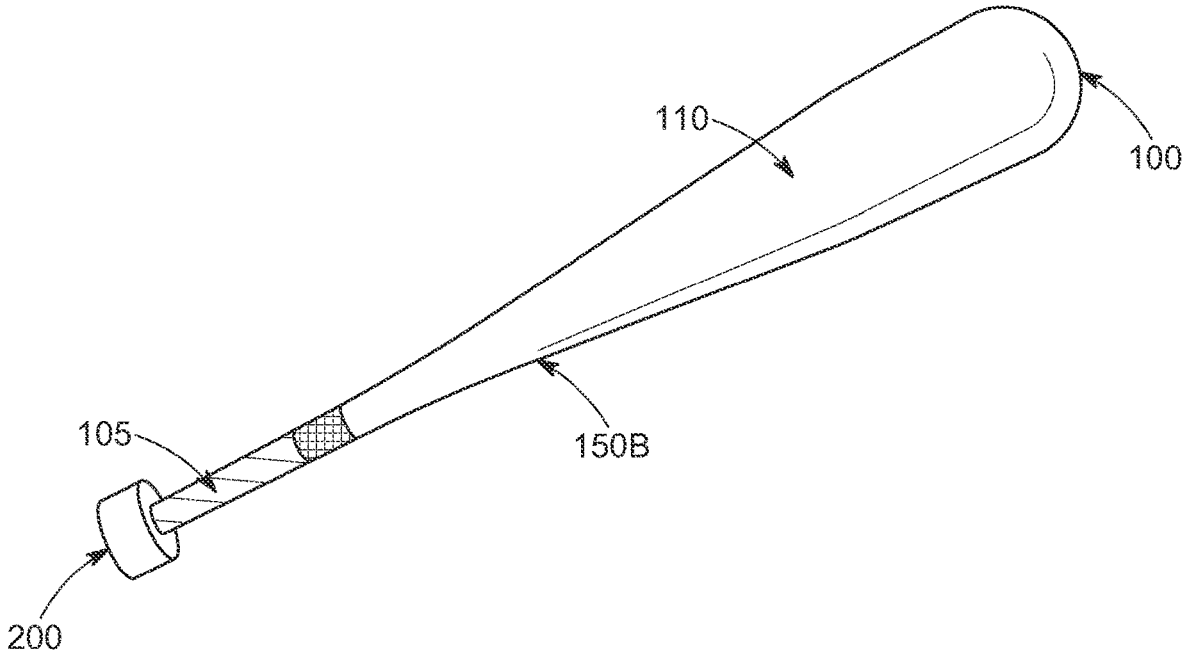
FIG. 3B is a perspective view of a bat with an implementation of a balance accessory affixed thereto.

FIG. 3B is a perspective view of a bat with an implementation of a balance accessory affixed thereto.

When a balance accessory 200 is affixed to the knob of bat 100, the center of mass 150B moves closer to the knob and handle 105 and away from barrel 110 due to the greater amount of mass located towards knob and handle 105. As discussed above, the mass of the balance accessory 200 may correspond to a particular percentage or proportion of the mass of the bat or piece of sporting equipment.

Figure 4:
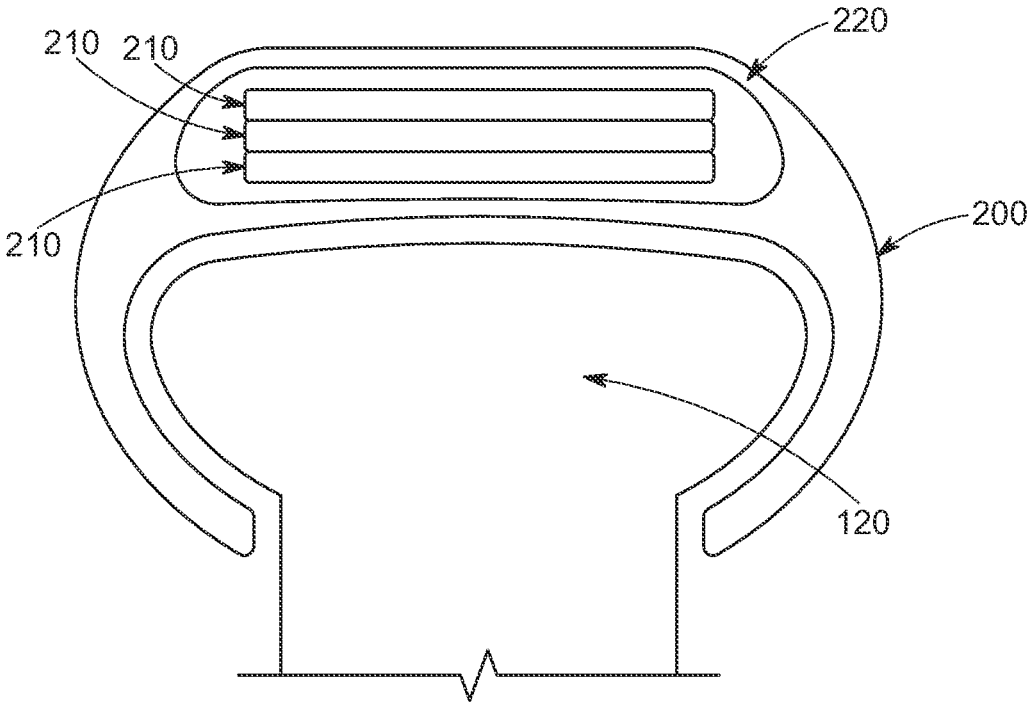
FIG. 4 is a side view of an implementation of a balance accessory.

FIG. 4 is a side view of an implementation of a balance accessory.

In some implementations, a balance accessory 200 comprises one or more weights 210. Weights 210 may comprise structures intended to increase the mass of the balance accessory 200. In some implementations, weights 210 may comprise a dense material, i.e. to achieve greater mass with smaller volume. In some implementations, weights 210 may comprise a metal, such as tungsten, lead, iron, steel, copper, or the like. Weights 210 may comprise any shape or dimension. In some implementations, weights 210 may comprise a shape and/or dimension configured to an enclosure 220 of the balance accessory 200.

Weights may be of any desirable mass. As discussed above, the desirability of the mass of weights may be determined based on the item of sporting equipment to which the accessory is to be affixed. In some implementations, weights may be one ounce each. In some implementations, weights may be one-half ounce each. In some implementations, weights may be one-quarter ounce each. In some implementations, weights may be other fractions of one ounce. In some implementations, weights may be more than one ounce. In some implementations, a balance accessory may comprise a plurality of weights which may have differing denominations, i.e., one-quarter, one-half, one ounce, two ounces, and so forth. In some implementations, weights may be denominated in metric units or fractions thereof. Desirability of denominations and sub-denominations of weights may also be determined based on the mass and other characteristics of the item of sporting equipment to which the accessory is to be affixed.

In some implementations, enclosure 220 may comprise a structure configured to retain one or more weights 210 within its structure and further configured to attach or affix to the knob 120 of a bat. Enclosure 220 may comprise one or more structures comprising one or more materials according to different implementations.

Figure 5A:
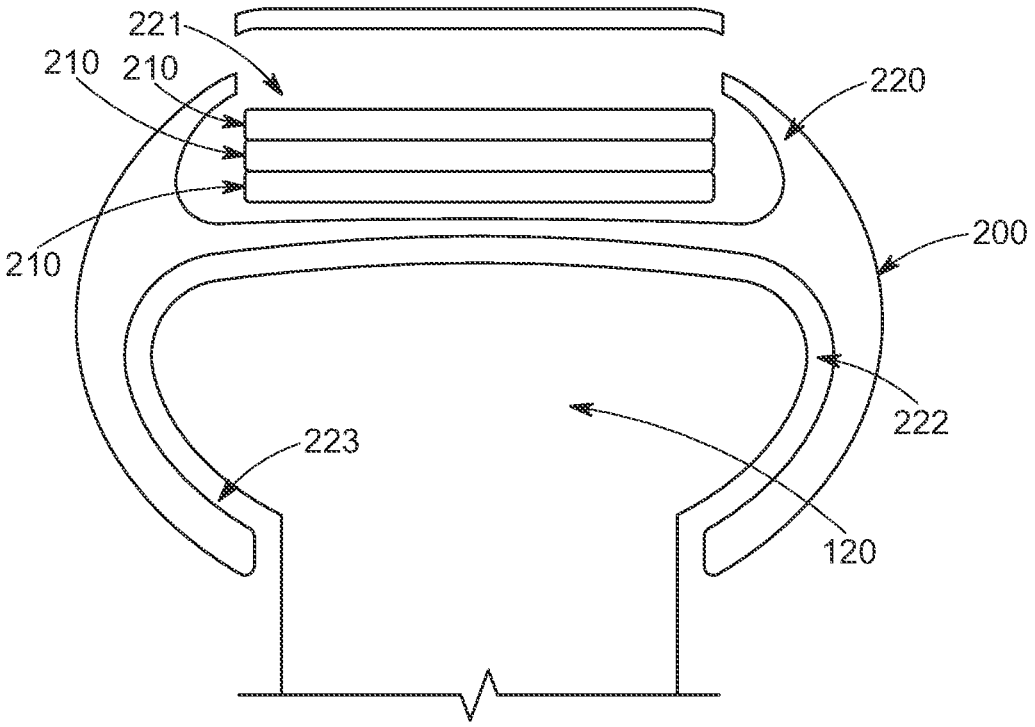
FIG. 5A is a side view of an implementation of a balance accessory.

FIG. 5A is a side view of an implementation of a balance accessory.

In the implementation shown in FIG. 5A, knob 120 has been placed within knob cavity 222. In the implementation shown in FIG. 5A, inner surface 223 of knob cavity 222 is not in contact with knob 120, demonstrating a relative arrangement of balance accessory 200 and knob 120 prior to full engagement of knob 120 in knob cavity 222. When fully engaged, inner surface 223 is in contact with knob 120 with respect to at least one point.

In some implementations, enclosure 220 may comprise a weight cavity 221. Weight cavity 221 may comprise an opening in the structure of enclosure 220 configured to hold one or more weights 210.

In some implementations, enclosure 220 may be configured to permit the addition or removal of weights from weight cavity 221. For example, in the implementation shown in FIG. 5A, weight cavity 221 is partially enclosed by the contiguous structure of the balance accessory 200. One face (in the implementation shown in FIG. 5A the face opposite the knob cavity 222), is configured to be removed from the balance accessory, thus permitting a user to access weight cavity 221 to add or remove weights 210. This removable face may be secured to the structure by, for example, screw threading between the removable face and the remainder of the structure, adhesive, snaps, clips, clamps, other sets of corresponding structures of the enclosure and the removable face(s) configured to mate with each other, or other suitable methods.

Figure 5B:
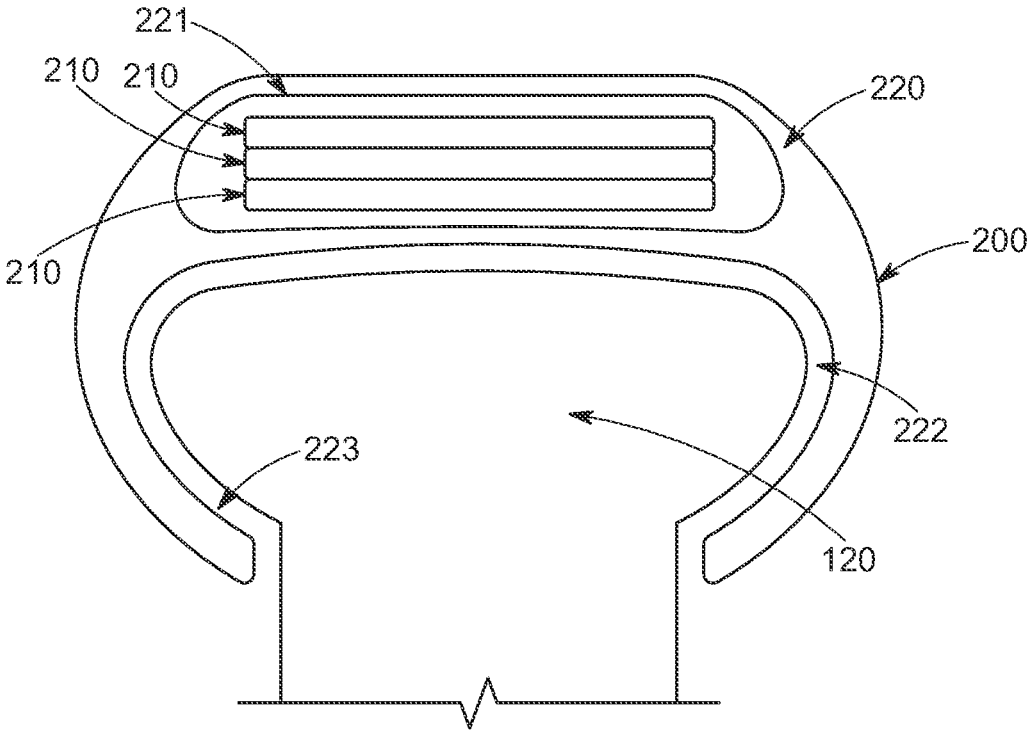
FIG. 5B is a side view of a balance accessory.

FIG. 5B is a side view of a balance accessory.

In the implementation shown in FIG. 5B, knob 120 has been placed within knob cavity 222. In the implementation shown in FIG. 5B, inner surface 223 of knob cavity 222 is not in contact with knob 120, demonstrating a relative arrangement of balance accessory 200 and knob 120 prior to full engagement of knob 120 in knob cavity 222. When fully engaged, inner surface 223 is in contact with knob 120 with respect to at least one point.

In the implementation shown in FIG. 5B, the removable face of enclosure 220 has been secured to the balance accessory 200, thereby securing weights 210 within the enclosure 220.

Figure 6A:
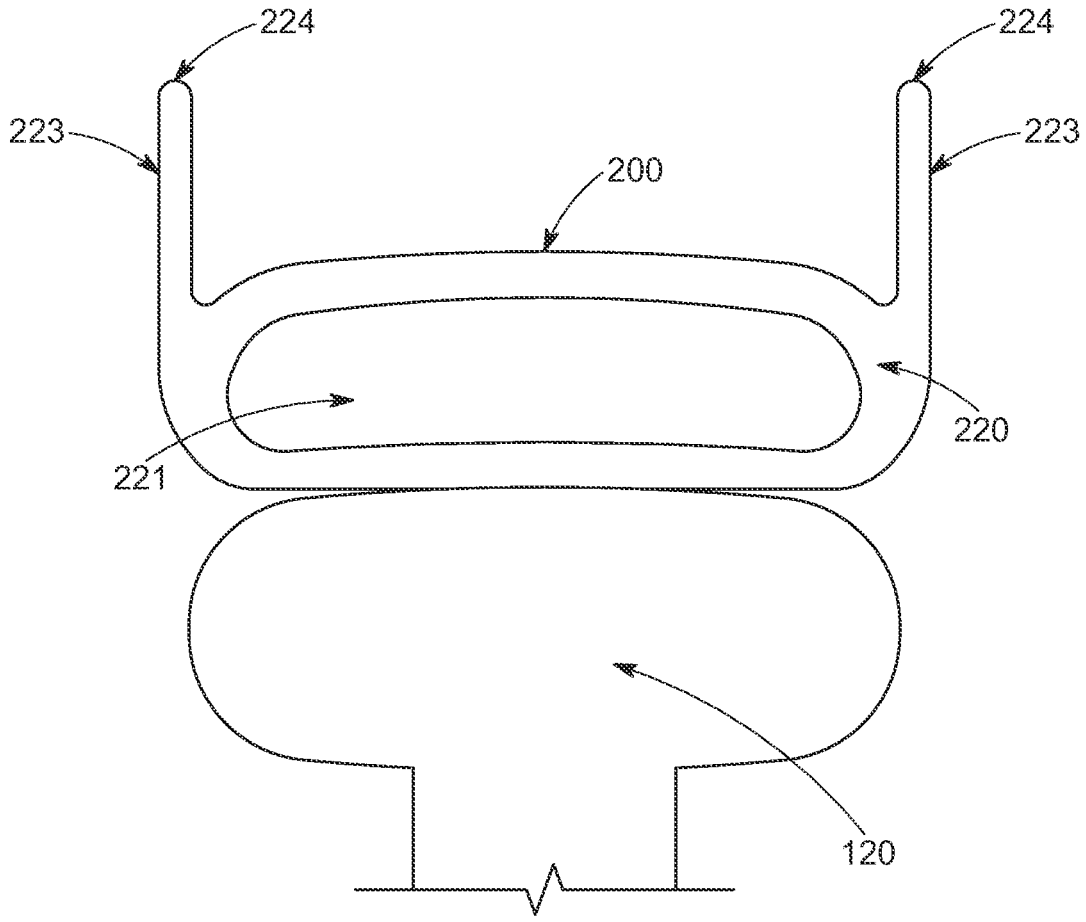
FIG. 6A is a side view of a balance accessory.

FIG. 6A is a side view of a balance accessory.

The implementation of a balance accessory 200 in FIG. 6A comprises an enclosure 220 and weight cavity 221. Balance accessory 200 is placed on one end of knob 120. In some implementations, a knob cavity may comprise a non-continuous structure. In some implementations, knob cavity may comprise a plurality of protrusions 224. In some implementations, protrusions 224 may comprise an inner surface 223 configured to engage the knob of a bat. In some implementations, protrusions 224 may be configured to rotate, flip, or otherwise disengage from the knob of a bat. In some implementations, protrusions 224 may be configured to occupy a first position wherein protrusions 224 are oriented away from the knob or otherwise disengaged from the knob. In some implementations, protrusions 224 may be configured to be locked or fixed in the first position. In other implementations, in the first position protrusions 224 may be disengaged from the knob 120 but not otherwise fixed in a position, i.e., protrusions 224 are freely moving, such as in an implementation where protrusions comprise an elastic material.

Figure 6B:
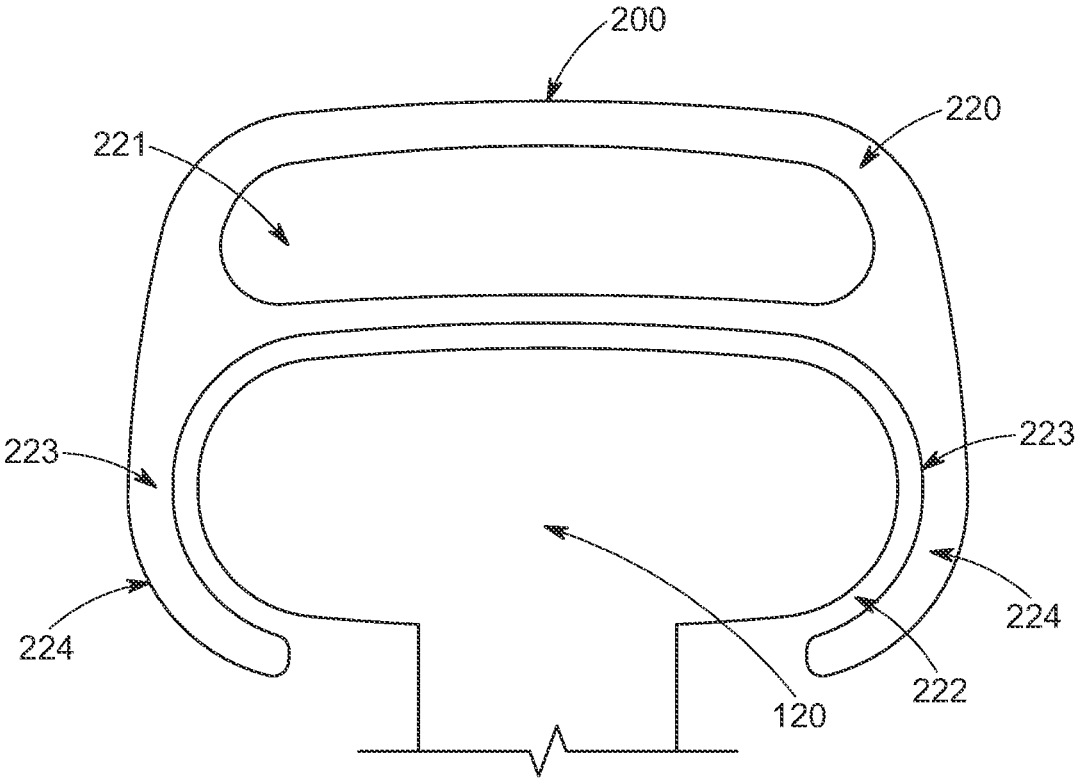
FIG. 6B is a side view of a balance accessory.

FIG. 6B is a side view of a balance accessory.

The implementation of a balance accessory 200 in FIG. 6B comprises an enclosure 220 and weight cavity 221. Balance accessory 200 is placed on one end of knob 120. In some implementations, protrusions 224 may be configured to occupy a second position wherein protrusions 224 are engaged with the knob, thereby forming a knob cavity 222 and affixing the balance accessory to the knob 120 of a bat. When so manipulated, inner surface 223 may be moved into contact with knob 120—however FIG. 6B demonstrates a relative arrangement of balance accessory 200 and knob 120 prior to full engagement of knob 120 in knob cavity 222. In some implementations, a user may manipulate protrusions 224 between the first and second positions to affix or remove the balance accessory to the knob 120. In some implementations, an accessory may comprise additional structures (not shown in FIG. 6B) to assist or enable protrusions 224 to be affixed to the knob or to such other structures in a manner which results in the accessory being affixed to the knob.

In some implementations, an accessory may comprise two protrusions 224 located on opposing sides of the accessory. In some implementations, an accessory may comprise four protrusions 224 spaced equidistantly around the circumference of the accessory, i.e., a first protrusion located at 0 degrees, a second protrusion located at 90 degrees, a third protrusion located at 180 degrees, and a fourth protrusion located at 270 degrees. In some implementations, an accessory may comprise more than four protrusions spaced around the circumference of the accessory, such as 5, 6, 8, or 10 protrusions. In some implementations, protrusions are spaced equidistantly around the circumference of the accessory. In other implementations, protrusions are not spaced equidistantly around the circumference of the accessory.

Figure 7:
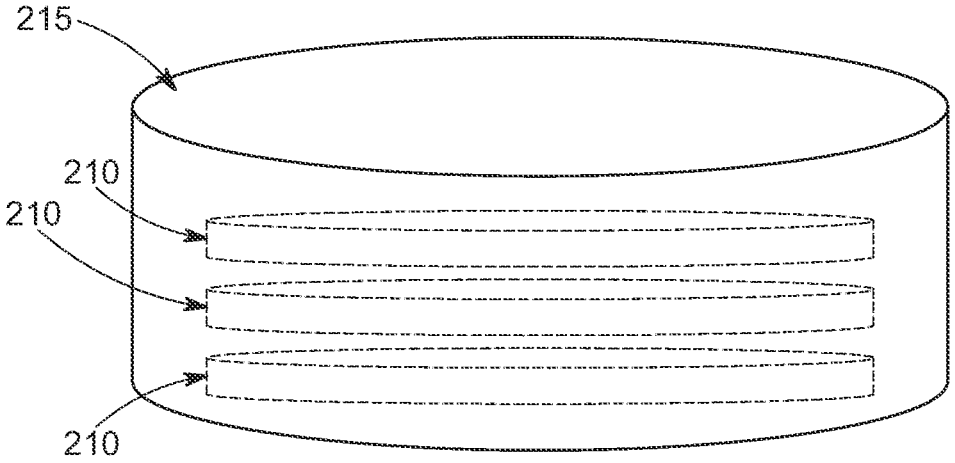
FIG. 7 is a perspective view of an implementation of a weight capsule.

FIG. 7 is a perspective view of an implementation of a weight capsule.

In some implementations, a balance accessory comprises a weight capsule 215. Weight capsule 215 may comprise a structure configured to hold one or more weights 210. In some implementations, weight capsule 215 is further configured to fit within an enclosure (not shown) or weight cavity (not shown) of a balance accessory. Weight capsule 215 may be configured to hold a plurality of weights 210 rather than requiring the plurality of weights 210 be individually placed and held within the enclosure (not shown) or weight cavity (not shown) of a balance accessory. In some implementations, weights 210 and weight capsule 215 may be of such shapes and dimensions to facilitate the placement of one or more weights within weight capsule 215. For example, in some implementations weight capsule 215 may comprise a cylinder of a first fixed diameter and height, and weights may comprise cylinders of a second fixed diameter and height, where the second fixed diameter and height are smaller than the first fixed diameter and height.

In some implementations, weight capsule 215 may aid in reducing movement of weights 210 when the balance accessory is affixed to a piece of equipment and swung during use. In some implementations, weight capsule 215 may facilitate easier changing of total weight within a balance accessory, i.e. a player may have a first weight capsule containing 2 ounces of weights and a second capsule containing 4 ounces of weights, and may interchange weight capsules within the accessory rather than interchanging individual weights themselves. Such implementations may be desirable when a single piece of sporting equipment is shared between multiple athletes with different needs as to the adjustment of the center of mass of the sporting equipment.

Figure 8:
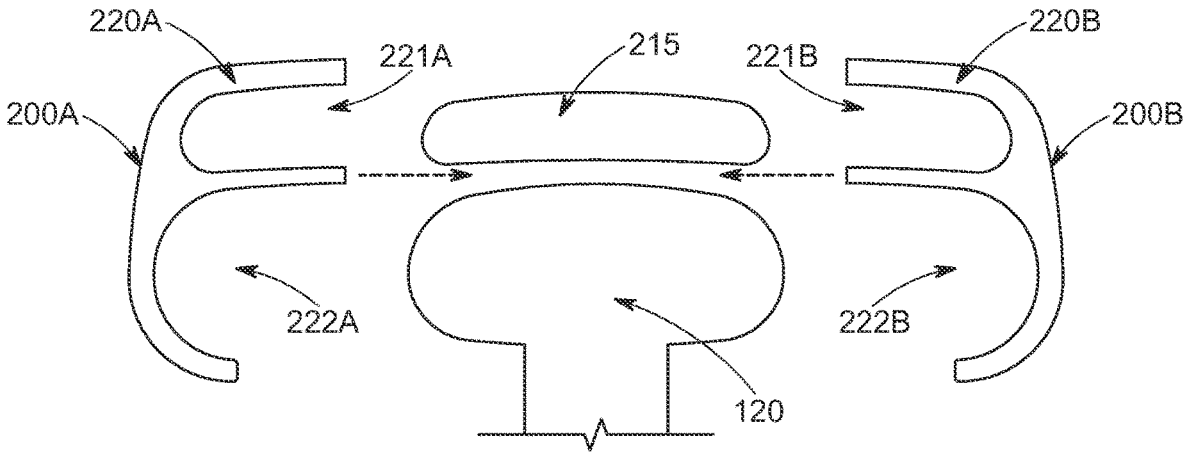
FIG. 8 is a side view of an implementation of a balance accessory.

FIG. 8 is a side view of an implementation of a balance accessory.

In some implementations, balance accessory 200 may comprise a first part 200A and a second part 200B. In such implementations, each of first part 200A and second part 200B may comprise partial forms of various other elements of a balance accessory. In such implementations, first part 200A may comprise a first part of enclosure 220A, first part of weight cavity 221A, first part of knob cavity 222A, and so forth; and second part 200B may comprise a second part of enclosure 220B, second part of weight cavity 221B, second part of knob cavity 222B, and so forth.

In such implementations, first part 200A and second part 200B may be configured to join together. First part 200A and second part 200B may be joined together by any means, such as screws, snaps, buttons, hook fasteners, adhesive, or the like. In some implementations, first part 200A and second part 200B may comprise additional structures (not shown) where such structures are configured to mate with corresponding structures on the other part and thus join first part 200A and second part 200B into a single element. In some implementations, first part 200A and second part 200B are configured to join together about knob 120. When first part 200A and second part 200B are joined together their respective first and second parts of constituent elements of a balance accessory.

In the implementation shown in FIG. 8, when first part 200A and second part 220B are joined together about knob 120, as shown by the dashed arrows, their respective first and second parts form the constituent elements of a balance accessory. The first part of knob cavity 222A and second part of knob cavity 222B form a single knob cavity around knob 120. The first part of enclosure 220A and second part of enclosure 220B form a single enclosure around weight capsule 215.

Figure 9:
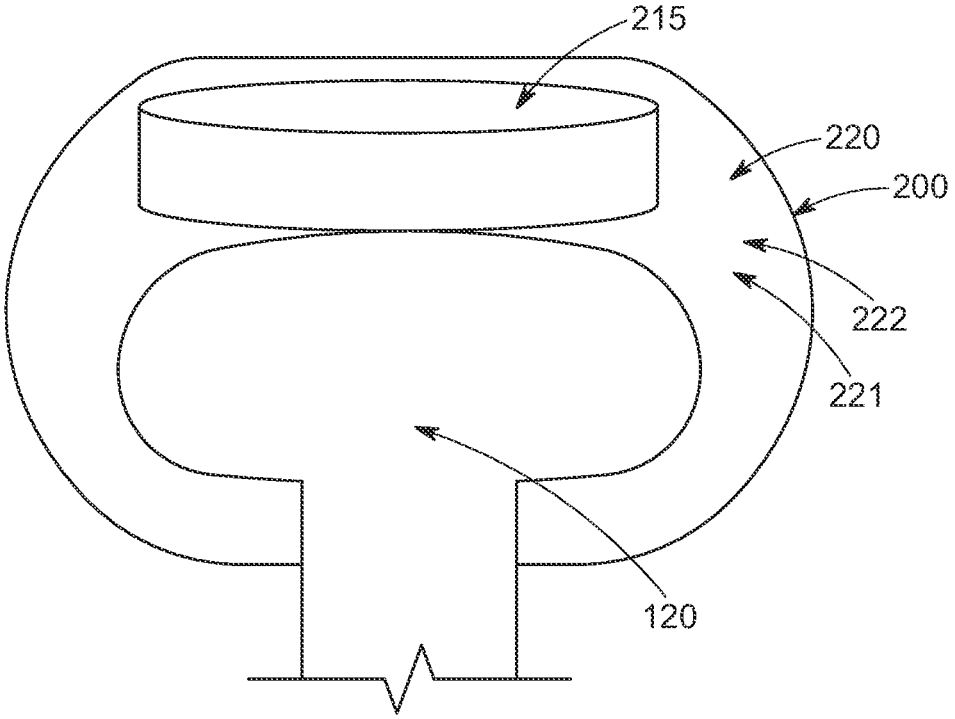
FIG. 9 is a side view of an implementation of a balance accessory.

FIG. 9 is a side view of an implementation of a balance accessory.

In some implementations, weight cavity 221 and knob cavity 222 may comprise a single void, i.e., weight cavity 221 and knob cavity 222 are coextensive. In such implementations, both weights and a knob may be contained within the same space. In some implementations, the void comprising weight cavity 221 and knob cavity 222 may be configured to contain a weight capsule 215. In some implementations, this results in enclosure 220 comprising a coextensive weight cavity 221 and knob cavity 222.

In some implementations, a weight capsule 215 may be placed against the knob 120 of a bat and then enclosed by the balance accessory enclosure 220 comprising weight cavity 221 and knob cavity 222. FIG. 9 shows this arrangement where both the weight capsule 215 and knob 120 are contained within the structure of the balance accessory 200.

Figure 10:
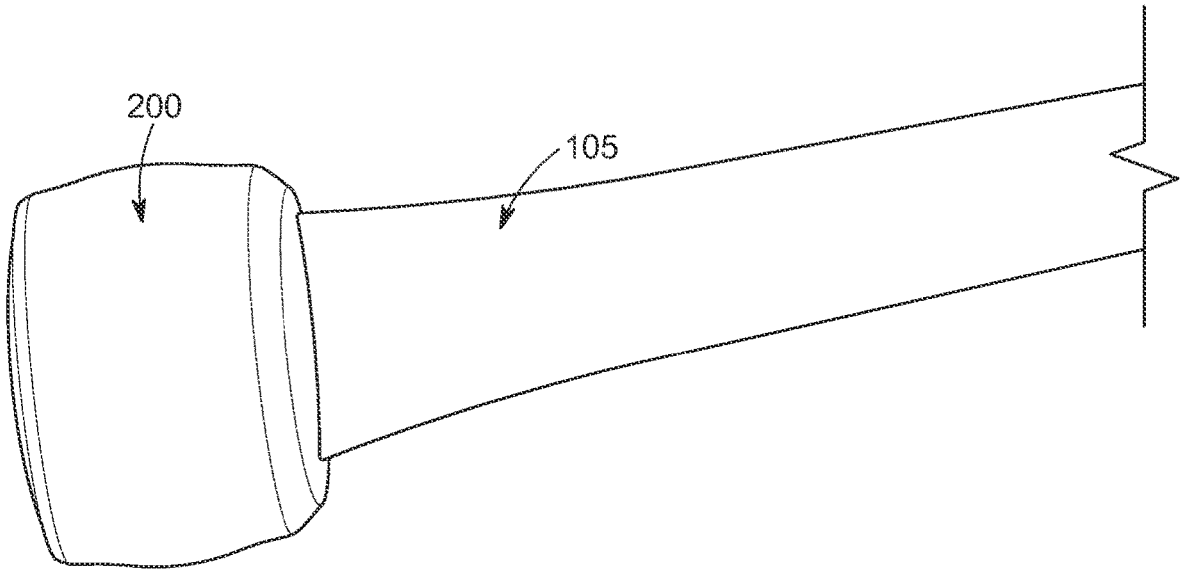
FIG. 10 is a side view of an implementation of a balance accessory affixed to a bat.

FIG. 10 is a side view of an implementation of a balance accessory affixed to a bat.

FIG. 10 shows an implementation of a balance accessory 200 wherein the balance accessory comprises a structure configured to enclose the entirety of knob (not shown) of a bat at the end of the bat adjacent to the handle 105.

The various structures described herein may be comprised of any materials suitable for achieving the desired characteristics of such structure, such as strength, elasticity, mobility, and the like. In some implementations, a balance accessory or constituent elements thereof may be comprised of an elastic material, such as rubber (either natural or synthetic or a combination thereof), latex, or an elastomeric polymer. In some implementations, a balance accessory or constituent elements thereof may be comprised of a thermoplastic polymer, for example high density polyethylene, low density polyethylene, polyvinyl chloride, or the like. In some implementations, a balance accessory or constituent elements thereof may be comprised of a plastic, for example polyethylene, polyethylene terephthalate, polypropylene, polyester, polyurethane, or the like. In some implementations, a balance accessory or constituent elements thereof may be comprised of a composite material.

While certain implementations discussed to this point have referred to use of a balance accessory with a baseball bat, a balance accessory may be utilized on a variety of sports equipment. Similar to a baseball bat, a balance accessory may be configured to affix to a softball bat in substantially the same manner as various implementations discussed herein.

In other implementations, a balance accessory may be configured to be affixed to a lacrosse stick. Lacrosse sticks comprise shafts with a first distal end and second distal end opposing each other. One distal end contains the head, or a netted basket used for holding and throwing the lacrosse ball during play. The opposite distal end of the shaft is located below the player's hands when the stick is held. In some implementations, a balance accessory may be configured to be affixed to the distal end of the shaft of the lacrosse stick opposite the head. Such implementations may permit greater throwing speed or accuracy by adjusting the center of mass of the lacrosse stick.

In other implementations, a balance accessory may be configured to be affixed to a tennis racquet, or a racquet for similar sports such as squash, racquetball, badminton, pickleball, or padel. In such sports, a racquet comprises a handle affixed to a wider hitting surface, where the hitting surface may comprise a solid or perforated surface, a network of strings woven across a frame, or the like. In some implementations, a balance accessory may be configured to be affixed to the end of the racquet adjacent to the handle.

In other implementations, a balance accessory may be configured to be affixed to the non-blade end of a hockey stick, or to the handle end of a cricket bat, in order to change the swinging mechanics of such sports equipment.

Implementations discussed herein are exemplary and are not intended to limit the full scope of the balance accessory. In some implementations, additional structure may assist in affixing or connecting a balance accessory to a piece of sporting equipment. For example, in some implementations one or more protrusions may be installed within the shaft of the piece of sporting equipment which are configured to mate with corresponding voids of the balance accessory. In some implementations, a balance accessory may comprise one or more protrusions configured to mate with corresponding voids in the shaft or structure of the sporting equipment. In some implementations, a collar may be provided which is configured to fit along the shaft of the sporting equipment (for example, around the handle of a baseball bat and secured against the knob), where such collar may then have means to mate or connect with a balance accessory or structural elements thereof to affix the balance accessory to the sporting equipment.

Various implementations may also provide additional means of adding or removing weights and/or weight capsules from the balance accessory. In some implementations, weights and/or weight capsules may be configured with screw threads and may be affixed to a balance accessory or to additional weights and/or weight capsules by mating corresponding screw threads. In some implementations, weights and/or weight capsules may comprise a protrusion on one side and a corresponding void on the opposing side, thereby permitting weights and/or weight capsules to be affixed to a balance accessory or to additional weights and/or weight capsules by mating the protrusion with the corresponding void of a balance accessory or additional weight or weight capsule. In some implementations, weights may comprise a thin cylindrical structure with a void in the center thereof (similar to a washer or o-ring) and a balance accessory may provide a protrusion configured to receive the void of one or more weights. In some implementations, weights and/or weight capsules may be secured by other means, such as adhesive, hook and loop fasteners, buttons, snaps, straps, or the like.

What is claimed is:

1. A sport equipment balance accessory comprising a structure, the structure comprising a cavity, the cavity configured to be affixed to a first distal end of an item of sporting equipment;

the structure having a mass such that the center of mass of the item of sporting equipment is moved towards the first distal end thereof to which the structure is affixed;

the structure further comprising a weight cavity configured to hold one or more weights;

the accessory further comprising a weight capsule, the weight capsule comprising a structure configured to hold a plurality of weights within it, and the weight cavity of the structure configured to contain the weight capsule.

2. The accessory of claim 1, wherein the cavity of the accessory is configured to contain the weight capsule while affixed to the first distal end of the piece of sporting equipment.

3. A sport equipment balance accessory comprising a structure, the structure comprising a cavity, the cavity configured to be affixed to a first distal end of an item of sporting equipment, the cavity configured to enclose the entirety of the perimeter of the first distal end of the item of sporting equipment, and the structure having a mass such that the center of mass of the item of sporting equipment is moved towards the distal end thereof to which the structure is affixed;

the accessory further comprising a weight capsule, the weight capsule comprising a structure configured to hold a plurality of weights within it, and wherein the cavity of the accessory is configured to contain the weight capsule while affixed to the first distal end of the piece of sporting equipment.

4. An accessory for affixing to a piece of sports equipment, the accessory resulting in a center of mass of the piece of equipment moving towards the end of the sports equipment to which the accessory is affixed, the accessory comprising:

An enclosure, the enclosure comprising:

A knob cavity configured to affix to a first distal end of the piece of sports equipment wherein the knob cavity encloses the entirety of the perimeter of the first distal end of the item of sporting equipment when the accessory is affixed to the piece of sports equipment;

the enclosure further comprising a weight cavity;

the enclosure further comprising a removable face permitting the addition or removal of weights to or from the weight cavity; and the accessory further comprising a weight capsule, the weight capsule comprising a structure configured to hold a plurality of weights within it, and the weight cavity configured to contain the weight capsule.

* * * * *